US009590378B2

(12) United States Patent
Lin et al.

(10) Patent No.: US 9,590,378 B2
(45) Date of Patent: Mar. 7, 2017

(54) USB3.0 CONNECTOR AND METHOD OF MAKING THE SAME

(71) Applicant: EXCEL CELL ELECTRONIC CO., LTD., Taichung (TW)

(72) Inventors: Chih-Ming Lin, Taichung (TW); Lee-Yen Sun, Taichung (TW)

(73) Assignee: EXCEL CELL ELECTRONIC CO., LTD., Taichung (TW)

( * ) Notice: Subject to any disclaimer, the term of this patent is extended or adjusted under 35 U.S.C. 154(b) by 377 days.

(21) Appl. No.: 14/277,430

(22) Filed: May 14, 2014

(65) Prior Publication Data

US 2014/0245606 A1 Sep. 4, 2014

Related U.S. Application Data

(62) Division of application No. 13/487,298, filed on Jun. 4, 2012, now Pat. No. 8,939,777.

(30) Foreign Application Priority Data

Jul. 27, 2011 (TW) ..... 100126607 A

(51) Int. Cl.
*H01R 43/00* (2006.01)
*H01R 43/16* (2006.01)
(Continued)

(52) U.S. Cl.
CPC ..... *H01R 43/16* (2013.01); *H01R 13/26* (2013.01); *H01R 13/6581* (2013.01); *H01R 24/60* (2013.01); *Y10T 29/49222* (2015.01)

(58) Field of Classification Search
CPC .... H01R 43/16; H01R 13/6581; H01R 13/26; H01R 24/60; Y10T 29/49222
(Continued)

(56) References Cited

U.S. PATENT DOCUMENTS 4,818,239 A * 4/1989 Erk ..... H01R 12/724 361/760
6,186,830 B1 2/2001 Lin et al.
(Continued)

FOREIGN PATENT DOCUMENTS

CN 201616519 U 10/2010
TW M329880 4/2008
(Continued)

OTHER PUBLICATIONS

Search Report for corresponding Chinese Patent App. No. 201110223628.4 dated May 29, 2014.
(Continued)

*Primary Examiner* — Peter DungBa Vo
*Assistant Examiner* — Azm Parvez
(74) *Attorney, Agent, or Firm* — Renner, Otto, Boisselle & Sklar, LLP

(57) ABSTRACT

A USB 3.0 connector includes an insulative body, a plurality of first and second terminals, and an outer shell covering the insulative body. The insulative body includes a base that has a base upper wall, a base lower wall, and two base sidewalls. The base lower wall has a rear end notched in a frontward direction to form a plurality of alternating shallow and deep notches to position first and second legs of the first and second terminals, which are bent downwardly. The alternating shallow and deep notches space the first legs apart from the second legs, respectively. The number of component parts for assembly is therefore reduced.

1 Claim, 17 Drawing Sheets

(51) Int. Cl.
*H01R 24/60* (2011.01)
*H01R 13/26* (2006.01)
*H01R 13/6581* (2011.01)

(58) Field of Classification Search
USPC ..... 29/884, 876, 874, 825, 592.1
See application file for complete search history.

(56) References Cited

U.S. PATENT DOCUMENTS

| | | | |
|---|---|---|---|
| 7,473,136 | B2 | 1/2009 | Hu et al. |
| 7,682,163 | B2 | 3/2010 | Hou et al. |
| 2009/0305532 | A1 | 12/2009 | Hou et al. |
| 2010/0297884 | A1 | 11/2010 | Hung et al. |
| 2010/0303421 | A1 | 12/2010 | He et al. |

FOREIGN PATENT DOCUMENTS

| | | |
|---|---|---|
| TW | M348372 | 1/2009 |
| TW | M393845 | 12/2010 |
| TW | M406856 | 7/2011 |

OTHER PUBLICATIONS

Office Action for corresponding Chinese Patent Application No. 201110223628.4 dated Jan. 4, 2015.
Search Report for corresponding TW Patent App. No. 100126607 dated Jan. 6, 2014.

* cited by examiner

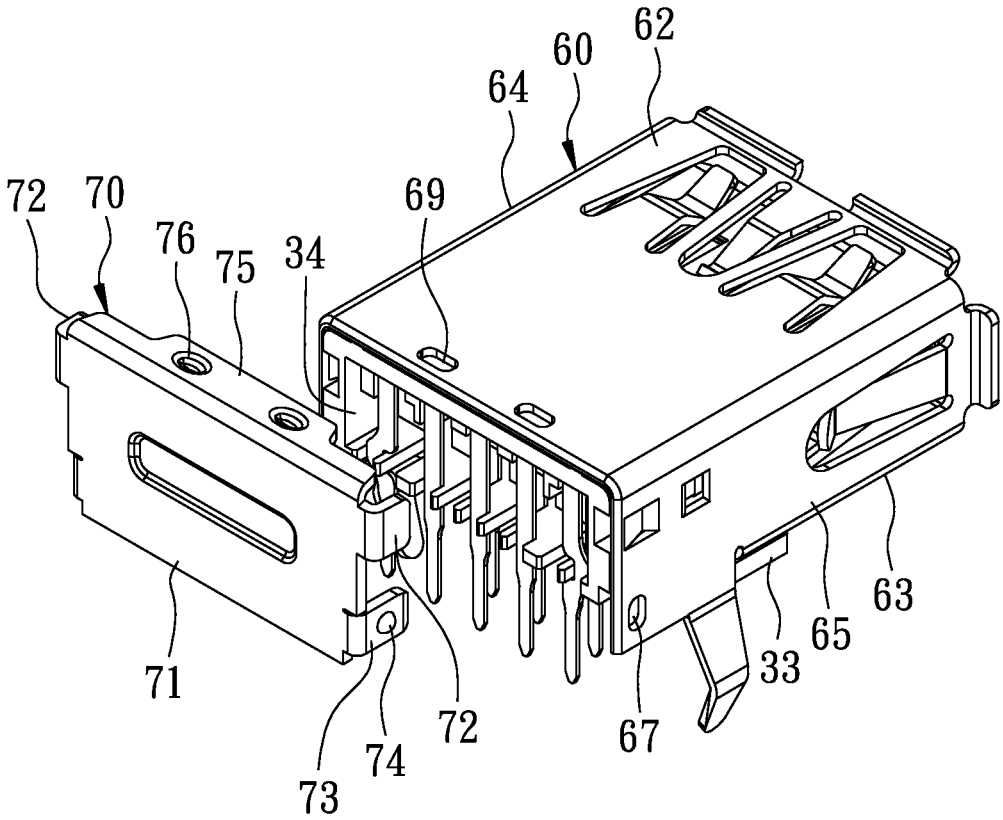
FIG. 24
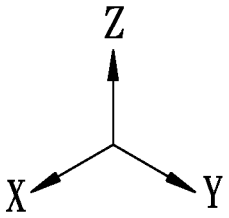

USB3.0 CONNECTOR AND METHOD OF MAKING THE SAME

CROSS REFERENCE TO RELATED APPLICATION

This application is a divisional of U.S. patent application Ser. No. 13/487,298 filed on Jun. 4, 2012, which claims priority of Taiwanese Application No. 100126607 filed on Jul. 27, 2011, all of which are incorporated herein by reference.

BACKGROUND OF THE INVENTION

1. Field of the Invention

The invention relates to an electrical connector, and more particularly to a USB 3.0 connector and the method of making thereof.

2. Description of the Related Art

USB (universal series bus) connectors have a functionality to transmit simultaneously both signals and power. Because the USB 3.0 connectors can provide a transmission speed larger than that of USB 2.0 connectors, they are increasingly replacing the USB 2.0 connectors.

Referring to FIG. 1, a method of making a conventional USB 3.0 connector 10 includes the following steps 20~29:

Referring FIG. 2 in combination with FIG. 1, in step 20, an insulative body 11 and a first terminal unit 12 are prepared. The insulative body 11 includes a base 111, a tongue plate 112 projecting forwardly from a front side of the base 111, and four positioning grooves 113 disposed at a rear of the base 111. The first terminal unit 12 includes a first connection plate 121 and four first terminals 122. Each first terminal 122 has a first contact plate 123, and a first leg 124 bending downwardly from the first contact plate 123. During assembly, the first contact plates 123 are fitted in the bottom side of the tongue plate 112, and the first legs 124 are passed respectively through the positioning grooves 113. Thereafter, the first connection plate 121 is cut off.

Referring to FIG. 3, in step 21, a second terminal unit 13 is prepared. The second terminal unit 13 includes five second terminals 132 and a second connection plate 131. Each second terminal 132 has a second contact plate 133, and a second leg 134.

Referring to FIG. 4, in step 22, the second terminals 132 are assembled to the insulative body 11. During assembly, the second contact plates 133 are fitted in the top side of the tongue plate 112 and the second legs 134 extend rearwardly.

As shown in FIG. 5, in step 23, the second connection plate 131 is cut off.

As shown in FIG. 6, in step 24, a plastic positioning block 14 that has five insert slots 141 is prepared.

As shown in FIG. 7, in step 25, the plastic positioning block 14 is assembled with the second terminals 132. During assembly, the second legs 134 are inserted into the insert slots 141.

As shown in FIG. 8, in step 26, the second legs 134 are bent. For operation, a force is exerted upon the plastic positioning block 14 to bend the second legs 134 downward. Since the plastic positioning block 14 is disposed at the rear of the base 111, the plastic positioning block 14 can prevent the first legs 124 from contacting the second legs 134.

As shown in FIG. 9, in step 27, the outer shell 15 is prepared. The outer shell 15 includes a shell top wall 152, a shell bottom wall 153, and two shell sidewalls 154, 155 that cooperate to confine an accommodation chamber 151. Each shell sidewall 154, 155 has a protrusion 156. The outer shell 15 further has a rear cover 157 extending from a rear of the shell top wall 152, and a pair of engaging plates 158 bent downwardly from the rear cover 157.

As shown in FIG. 10, in step 28, the outer shell 15 is assembled to the insulative body 11 by inserting the insulative body 11 into the accommodation chamber 151.

As shown in FIG. 11, in step 29, the rear cover 157 is bent. For operation, a force is exerted upon the rear cover 157 to bend the rear cover 157 downwardly, and the protrusion 156 is caused to engage the engaging plates 158 so as to position the rear cover 157 to the plastic positioning block 14.

The conventional method of making the USB 3.0 connector 10 has the following disadvantages:

1) The plastic positioning block 14 is needed to space the first legs 124 apart from the second legs 134. In order to assemble the plastic positioning block 14 to the second legs 134, in steps 22 to 25, the second legs 134 have to extend rearwardly. Because the first terminal unit 12 is not well positioned, during assembly, the plastic positioning block 14 tends to press and cause the first terminal unit 12 to become twisted.

2) The need to use the plastic positioning block 14 increases the number of component parts of the connector 10, thereby increasing the manufacturing steps and cost.

3) The rear cover 157 merely improves an aesthetic effect of the USB 3.0 connector 10. Because the rear cover 157 is directly formed on the shell top wall 152, the connector 10 provides no option to remove the rear cover 157 and to reduce costs.

4) Because no interlocking means is provided between the outer shell 15 and the insulative body 11 to prevent the outer shell 15 from escaping from the insulative body 11, the quality of the products is relatively low.

SUMMARY OF THE INVENTION

An object of the present invention is to provide a USB 3.0 connector with a reduced number of component parts, which can be manufactured at a reduced cost and with an increased quality.

Another object of the present invention is to provide a method for making a USB 3.0 connector in which the number of component parts and manufacturing steps are reduced and the production efficiency is increased.

According to one aspect of the invention, a USB 3.0 connector comprises an insulative body, a plurality of first terminals, a plurality of second terminals and an outer shell covering the insulative body.

The insulative body includes a base that has a base upper wall, a base lower wall, two base sidewalls interconnecting the base upper and lower walls, a tongue plate projecting forwardly from a front side of the base, a clamp plate projecting forwardly from a bottom side of the base lower wall, and a rear recess that is formed in a rear part of the base and that is surrounded by the base upper and lower walls and the base sidewalls. The base lower wall has a rear end notched in a frontward direction to form a plurality of alternating shallow and deep notches. Each of the base sidewalls has a guide groove extending in a front-rear direction.

Each of the first terminals has a first contact plate fitted in a bottom side of the tongue plate, and a first leg bending downwardly from the first contact plate and extending through one of the deep notches.

Each of the second terminals has a second contact plate fitted in a top side of the tongue plate, and a second leg bending downwardly from the second contact plate and extending through one of the shallow notches.

The outer shell includes a shell top wall, a shell bottom wall, and two shell sidewalls. The shell top wall is longer than and extends beyond a rear end of the shell bottom wall. Each of the shell sidewalls has a guide tab engaging the guide groove of one of the base sidewalls.

According to another aspect of the invention, a method of making a USB 3.0 connector comprises the steps of:

preparing the insulative body and the first terminals;

fitting the first contact plates of the first terminals in the bottom side of the tongue plate, and extending the first legs respectively through the deep notches;

forming the second terminals and a connection plate which interconnects the second terminals;

assembling the second terminals with the tongue plate by pushing forwardly and fitting the second contact plates of the second terminals in the top side of the tongue plate, by extending the second legs of the second terminals through the shallow notches, respectively, and by engaging the second legs of two of the second terminals, which are respectively proximate to the base sidewalls, with the base lower wall, in such a manner that each of the two second terminals has the projecting outer edge abutting against an edge of the base lower wall proximate to the respective one of the shallow notches, and has the indented inner edge receiving and engaging an edge of the base lower wall proximate to the respective one of the shallow notches;

cutting off the connection plate of the second terminals;

preparing the outer shell; and assembling the outer shell with the insulative body by moving forwardly and inserting the insulative body into an interior of the outer shell, wherein the guide tabs are guided into the respective guide grooves and are slid over the respective wedge-shaped protrusions, the engaging lug of the outer shell is inserted into the engaging slot of the base, the clamp plate of the base clamps the bottom side of the shell bottom wall, and the shell bottom wall contacts against the base.

BRIEF DESCRIPTION OF THE DRAWINGS

Other features and advantages of the present invention will become apparent in the following detailed description of the preferred embodiment with reference to the accompanying drawings, of which:

FIGS. 19-24 illustrate consecutive steps of assembling the component parts of the preferred embodiment.

DETAILED DESCRIPTION OF THE PREFERRED EMBODIMENTS

Figure 1:
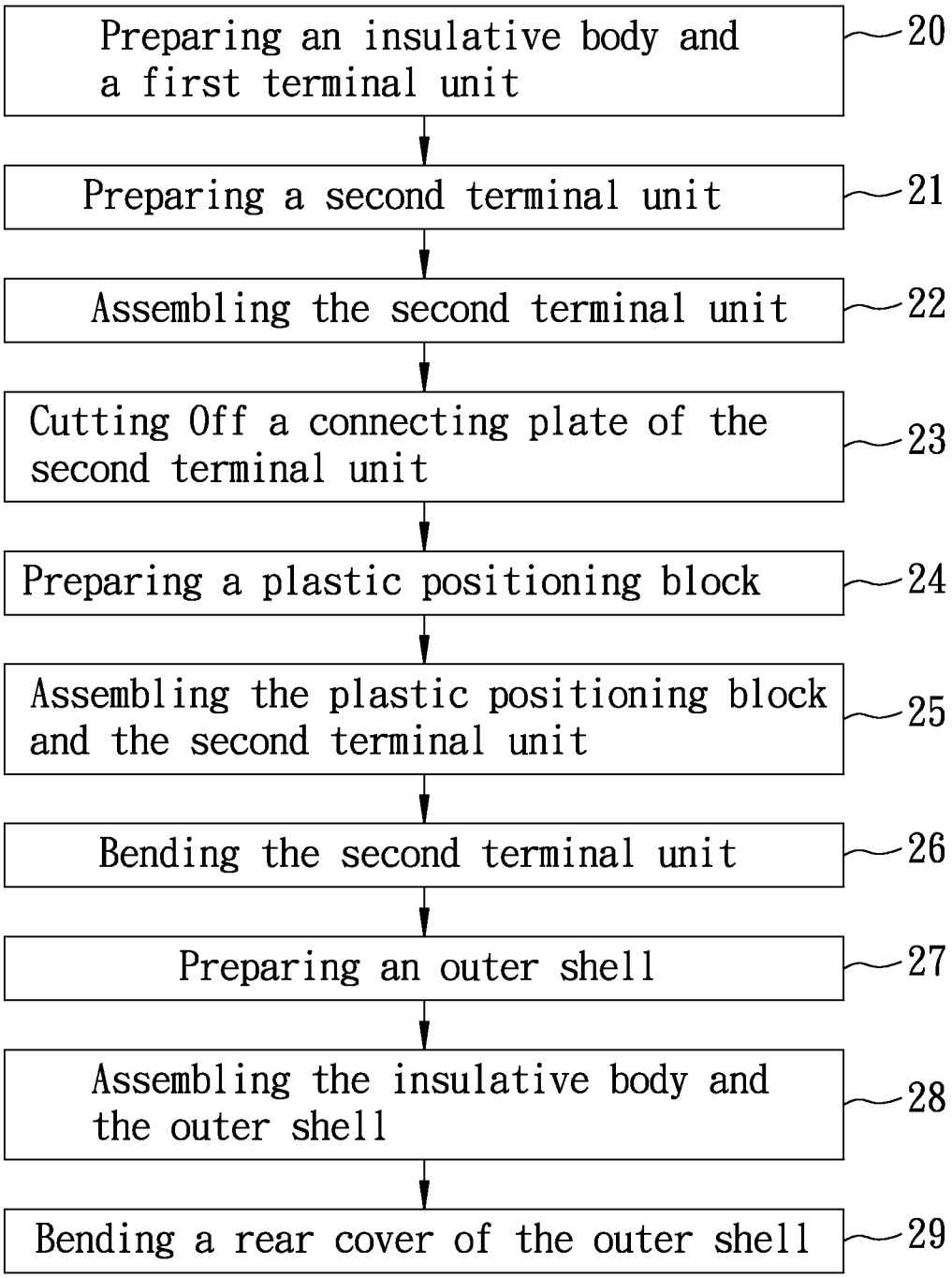
FIG. 1 PRIOR ART
FIG. 1 is a flow diagram for illustrating a conventional method of making a USB 3.0 connector.
Figure 2:
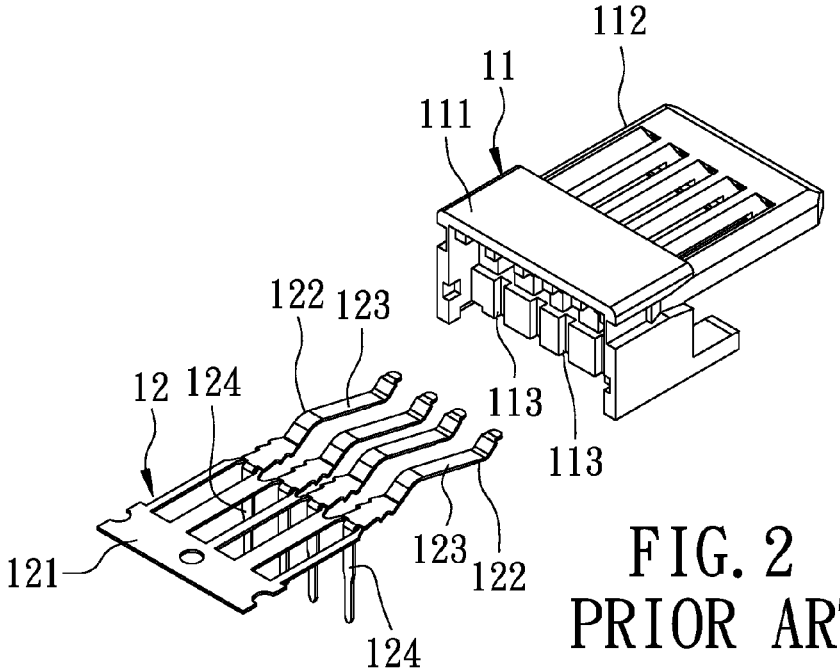
FIG. 2 PRIOR ART
FIGS. 2-11 are exploded perspective views illustrating consecutive steps of the conventional method of manufacturing the USB 3.0 connector.
Figure 3:
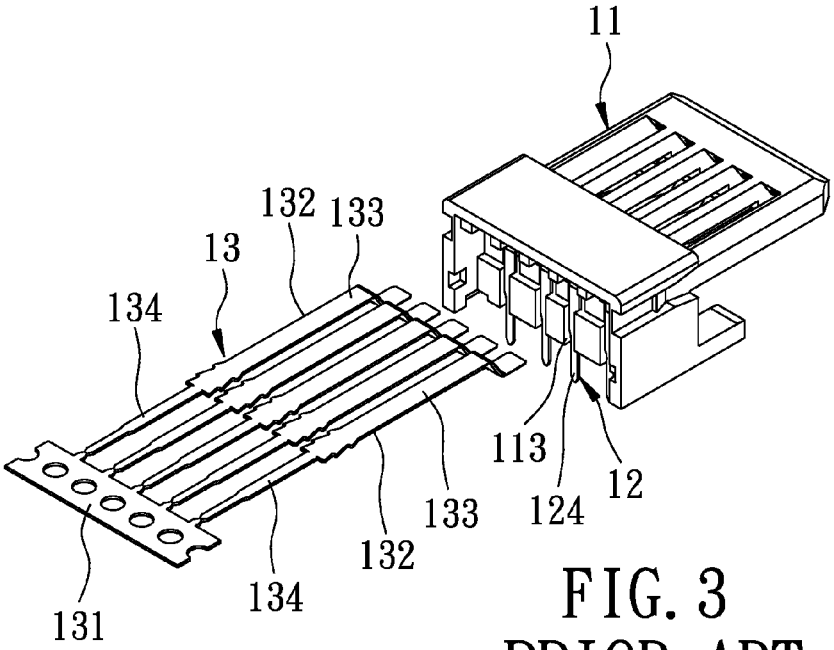
FIG. 3 PRIOR ART
Figure 4:
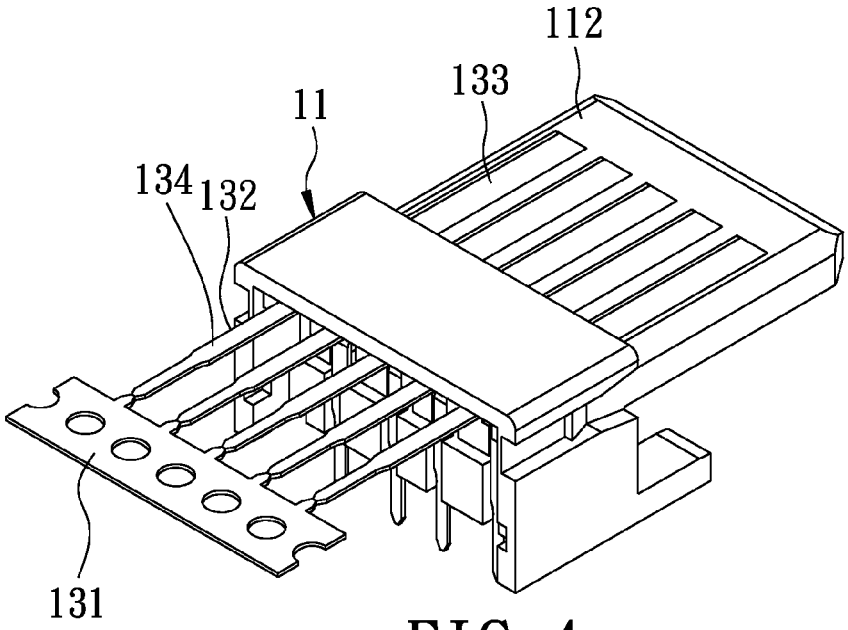
FIG. 4 PRIOR ART
Figure 5:
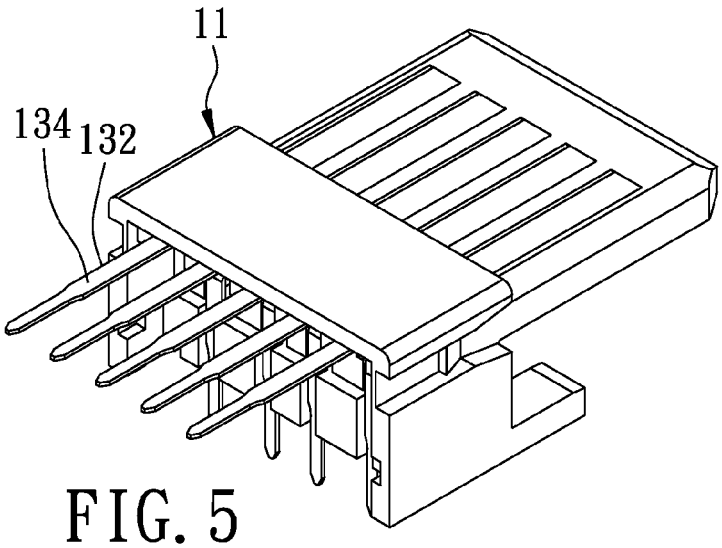
FIG. 5 PRIOR ART
Figure 6:
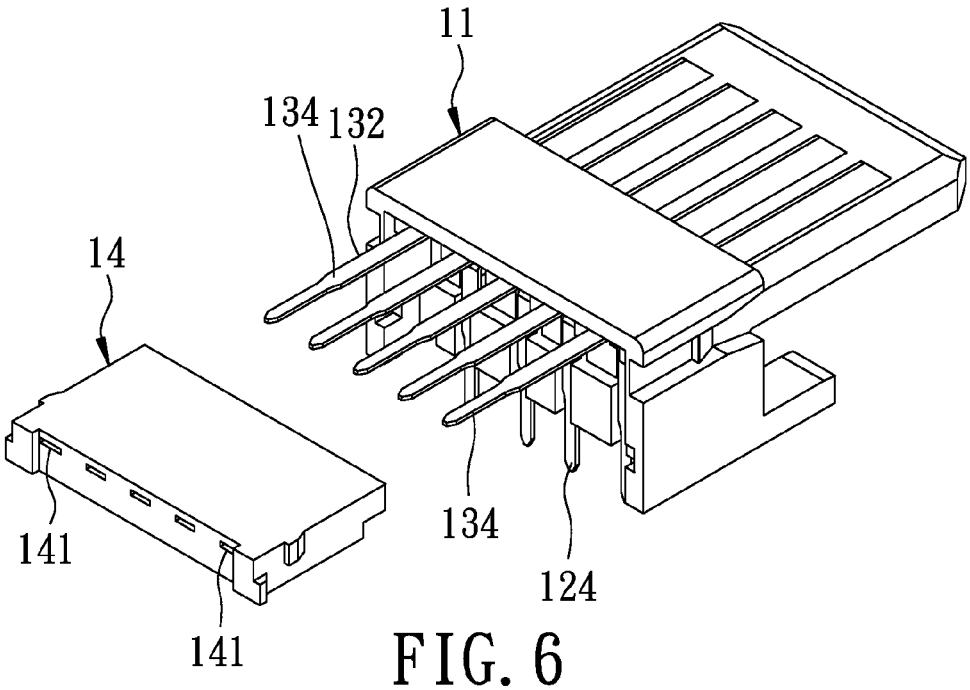
FIG. 6 PRIOR ART
Figure 7:
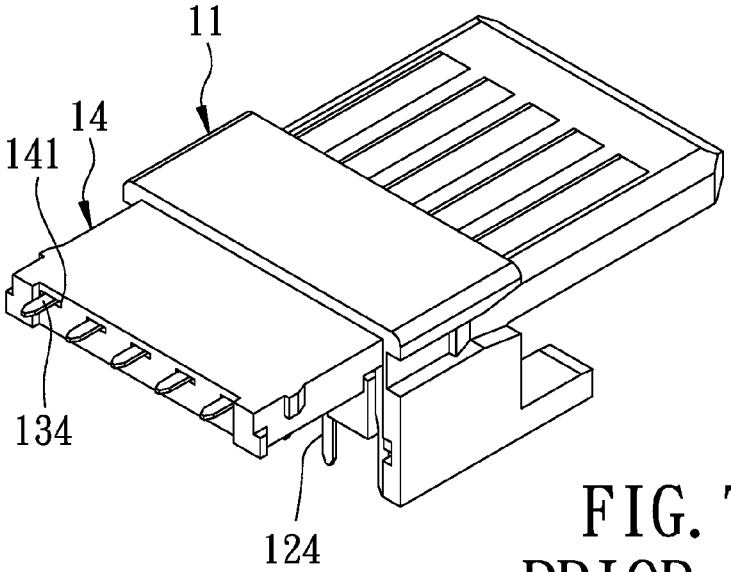
FIG. 7 PRIOR ART
Figure 8:
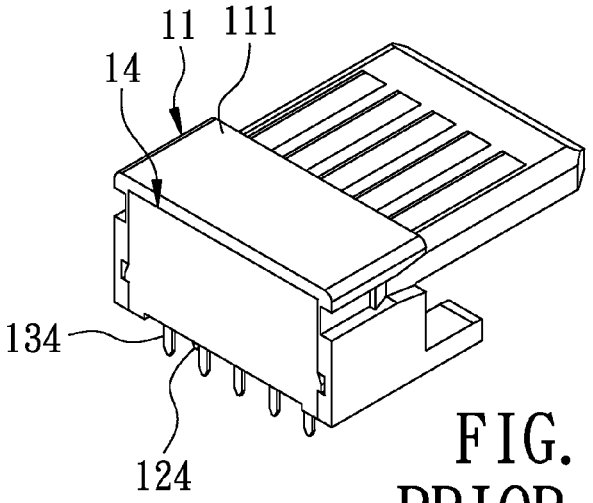
FIG. 8 PRIOR ART
Figure 9:
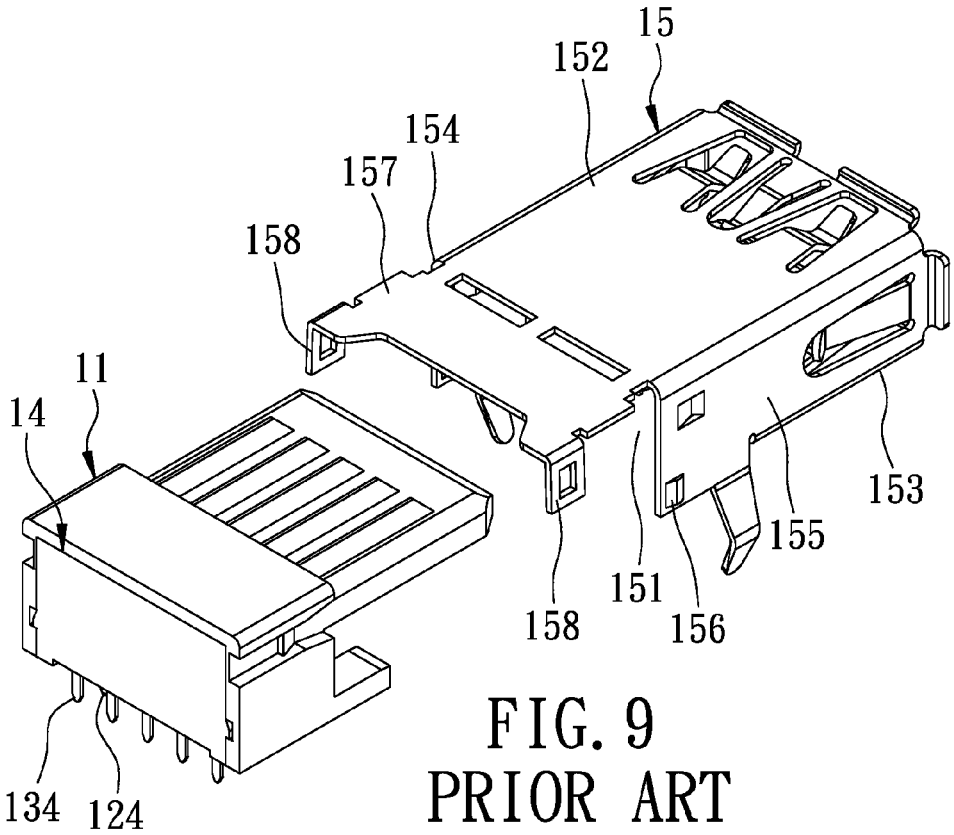
FIG. 9 PRIOR ART
Figure 10:
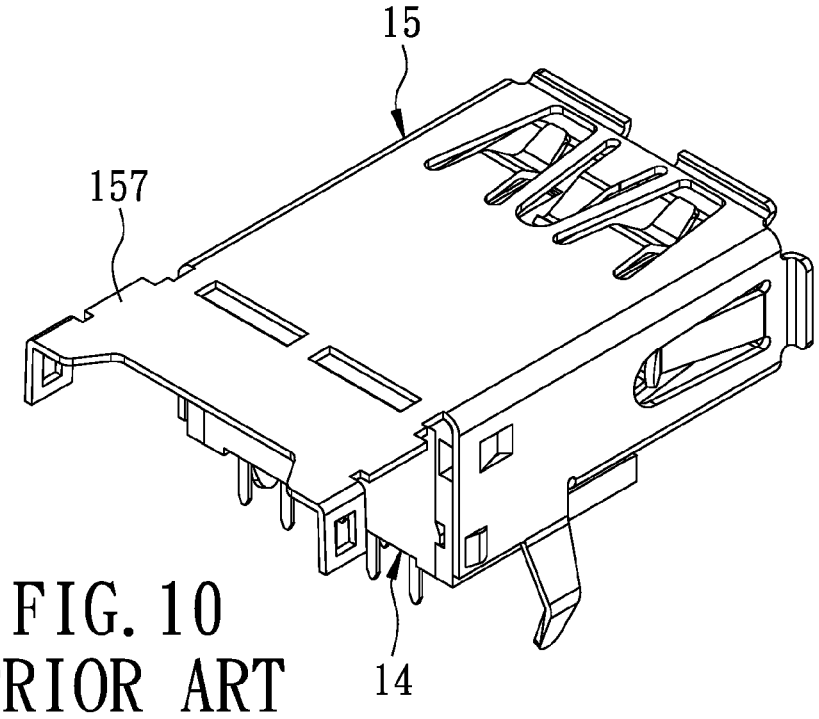
FIG. 10 PRIOR ART
Figure 11:
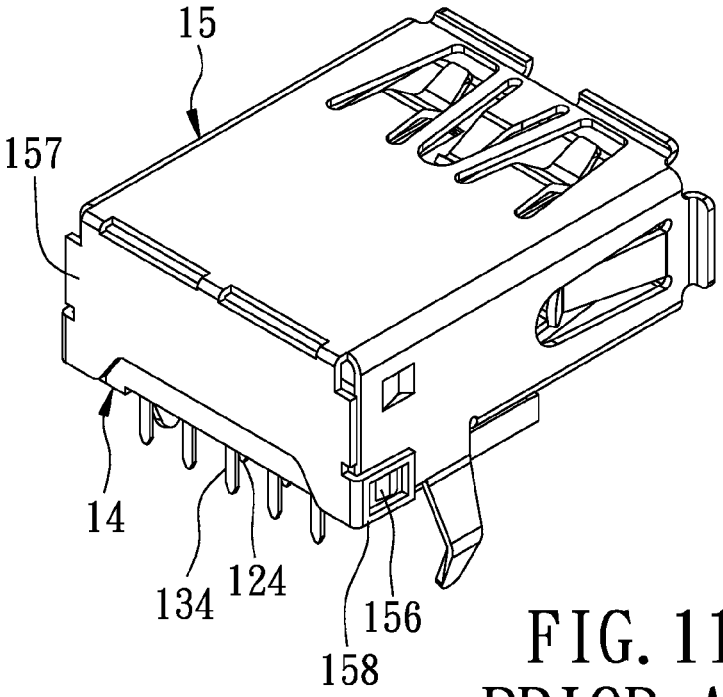
FIG. 11 PRIOR ART
Figure 12:
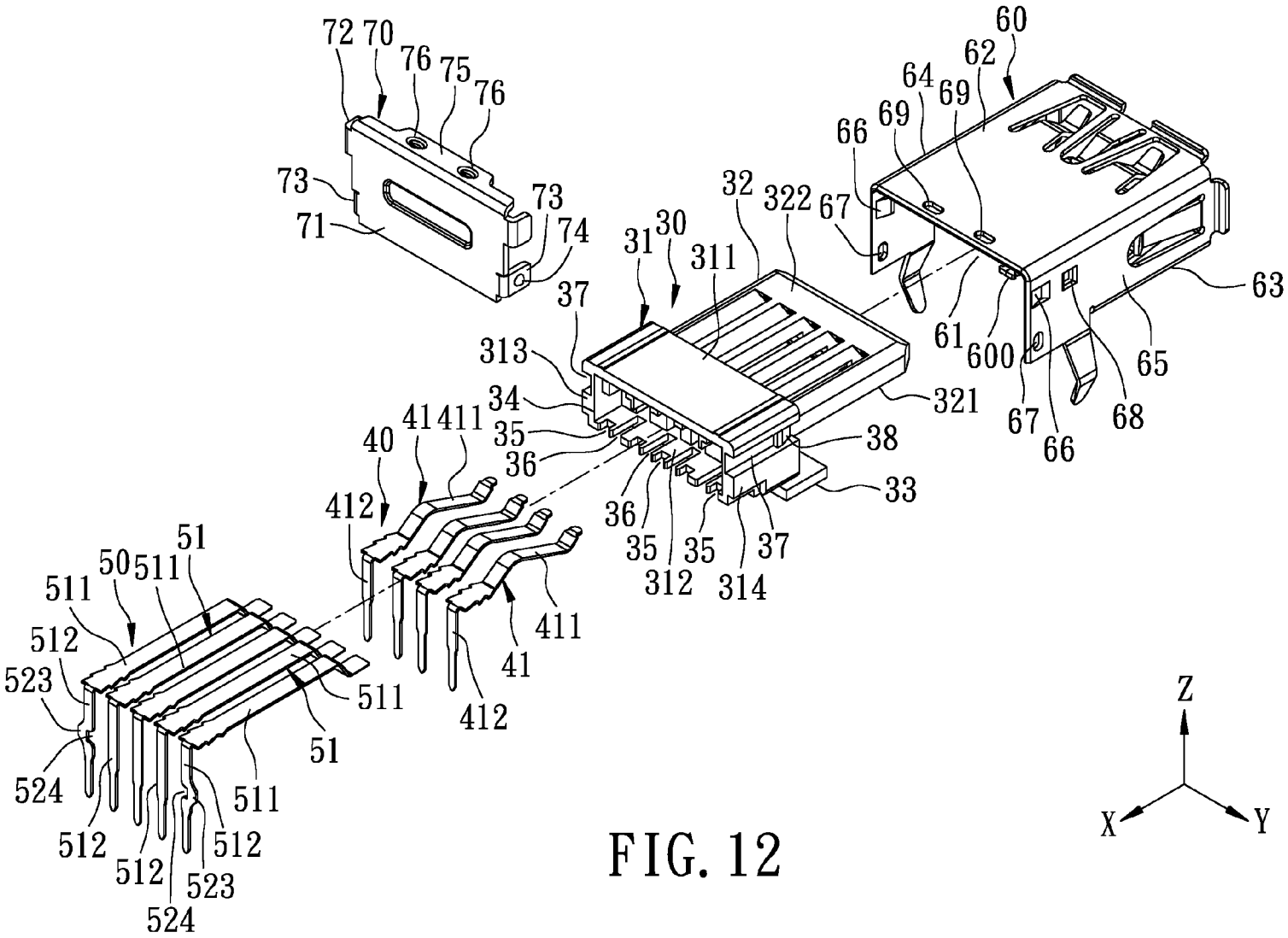
FIG. 12 is an exploded perspective view of a preferred embodiment of a USB 3.0 connector according to this invention.

Referring to FIG. 12, a preferred embodiment of a USB 3.0 connector according to the present invention is shown to include an insulative body 30, a first terminal unit 40, a second terminal unit 50, an outer shell 60 and a rear cover 70.

Figure 13:
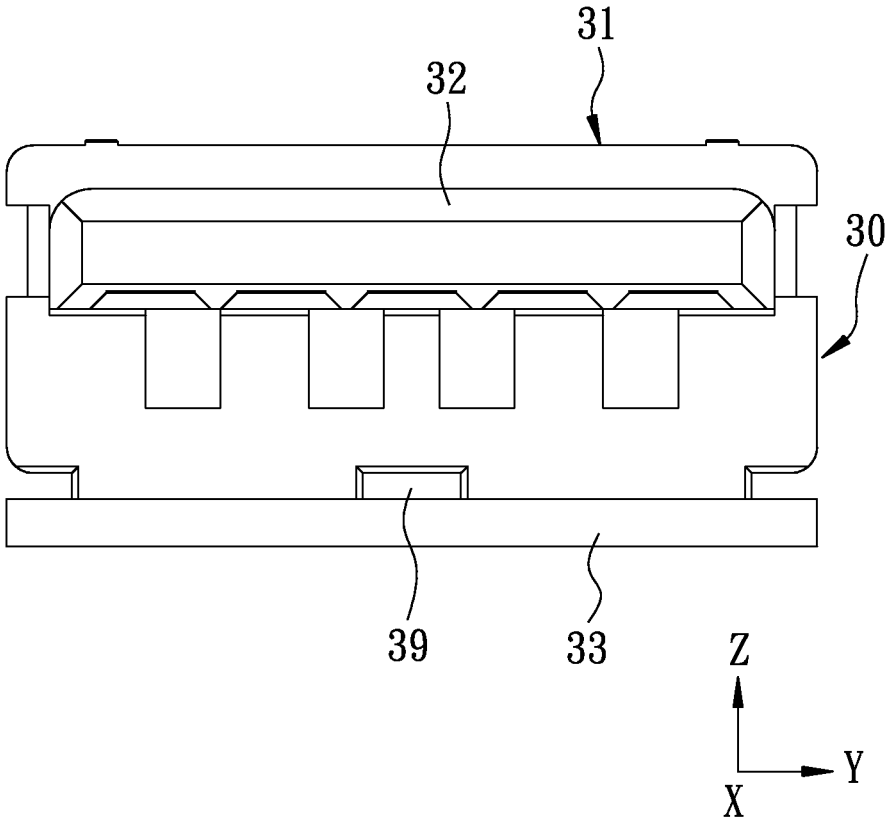
FIG. 13 is a front view of an insulative body of the preferred embodiment.

As shown from FIGS. 12 to 17, the insulative body 30 includes a base 31 that has a base upper wall 311, a base lower wall 312, two base sidewalls 313, 314 interconnecting the base upper and lower walls 311, 312, a tongue plate 32 projecting forwardly from a front side of the base 31, a clamp plate 33 projecting forwardly from a bottom side of the base lower wall 312, and a rear recess 34 that is formed in a rear part of the base 31 and that is surrounded by the base upper and lower walls 311, 312 and the base sidewalls 313, 314. The base lower wall 312 has a rear end notched in a frontward direction to form of five shallow notches 35 and four deep notches 36 that alternate with the shallow notches 35. Each of the base sidewalls 313, 314 has a guide groove 37 extending in a front-rear direction (X). Each of the base sidewalls 313, 314 further has a wedge-shaped protrusion 38 proximate to the front side of the base 31. The insulative body 30 further includes an engaging slot 39 (as best shown in FIG. 13) formed in the front side of the base 31 above the clamp plate 33.

The first terminal unit 40 includes four first terminals 41. Each first terminal 41 has a first contact plate 411 extending in the front-rear direction (X) and fitted in a bottom side 321 of the tongue plate 32, and a first leg 412 bending downwardly from the first contact plate 411 and extending through a respective one of the deep notches 36.

The second terminal units 50 includes five second terminals 51. Each second terminal 51 has a second contact plate 511 extending in the front-rear direction (X) and fitted in a top side 322 of the tongue plate 32, and a second leg 512 bending downwardly from the second contact plate 511 and extending through one of the shallow notches 35. Two of the second terminals 51 are proximate to the base sidewalls 313, 314, respectively, and the second leg 512 each of the two the second terminals 51 has a transversely projecting outer edge 523, and an indented inner edge 524 opposite to the projecting outer edge 523. The projecting outer edge 523 abuts against the base lower wall 312 adjacent a respective one of the shallow notches 35. The indented inner edge 524 receives and engages an edge of the base lower wall 312 adjacent to the respective one of the shallow notches 35.

The first terminals 41 and the second terminals 51 are assembled to the insulative body 30 independently. By extending the first legs 412 through the respective deep notches 36 and by extending the second legs 512 through the respective shallow notches 35, the first and second legs 412, 512 are positioned to the base 31, and are prevented from moving in the directions (X) and (Y) and from contacting each other.

The outer shell 60 is made of metal and includes a shell top wall 62, a shell bottom wall 63, and two shell sidewalls 64, 65 that cooperate to confine an accommodation chamber 61 for receiving the insulative body 30. The shell top wall 62 is longer than and extends beyond a rear end of the shell bottom wall 63. Each of the shell sidewalls 64, 65 has a guide tab 66 engaging the guide groove 37 of one of the base sidewalls 313, 314 and a first positioning hole 67. Moreover, each of the shell sidewalls 64, 65 further has a stop plate 68 in front of the guide tab 66. The shell top wall 62 is formed with a pair of second positioning holes 69 proximate to the rear end. The outer shell 60 further includes an engaging lug 600 projecting rearwardly from the shell bottom wall 63.

When the insulative body 30 is to be inserted into the accommodation chamber 61 of the outer shell 60, the guide tabs 66 are slid over the respective protrusions 38 and are guided into the respective guide grooves 37. Continued forward movement of the insulative body 30 enables the engaging lug 600 to extend into the engaging slot 39 and the clamp plate 33 to clamp the shell bottom wall 63 of the outer shell 60. When the shell bottom wall 63 touches the base 31, assembly of the insulative body 30 and the outer shell 60 is completed. By interengagement between the two stop plates 68 and the two protrusions 38, and between the engaging lug 600 and the engaging slot 39, separation of the insulative body 30 and the outer shell 60 can be effectively prevented.

The rear cover 70 is made of metal and has a rear plate 71 covering the rear recess 34 of the base 31, a top plate 75 projecting forwardly from a top end of the rear plate 71, two outer clamp plates 72 bending forwardly and respectively from two opposite ends of the rear plate 71 and extending over outer sides of the shell sidewalls 64, 65, respectively, two inner clamp plates 73 bending forwardly and respectively from two opposite ends of the rear plate 71 and inserted between the base 31 and the outer shell 60, two first protrusions 74 respectively projecting from outer surfaces of the inner clamp plates 73 and engaging the first positioning holes 67, and two second protrusions 76 projecting downwardly from the top plate 75 and engaging the second positioning holes 69.

For assembly, the rear cover 70 is pushed forward and is fitted around a rear part of the outer shell 60. Accordingly, the top plate 75 extends over the upper side of the shell top wall 62, the two second protrusions 76 engage the respective second positioning holes 69, the outer clamp plates 74 clamp the outer faces of the respective shell sidewalls 74, the two inner clamp plates 73 are inserted between the base and the shell sidewalls 74 to place the two first protrusions 74 in engagement with the first positioning holes 67. The rear cover 70 is optional and may be dispensed with.

Figure 18:
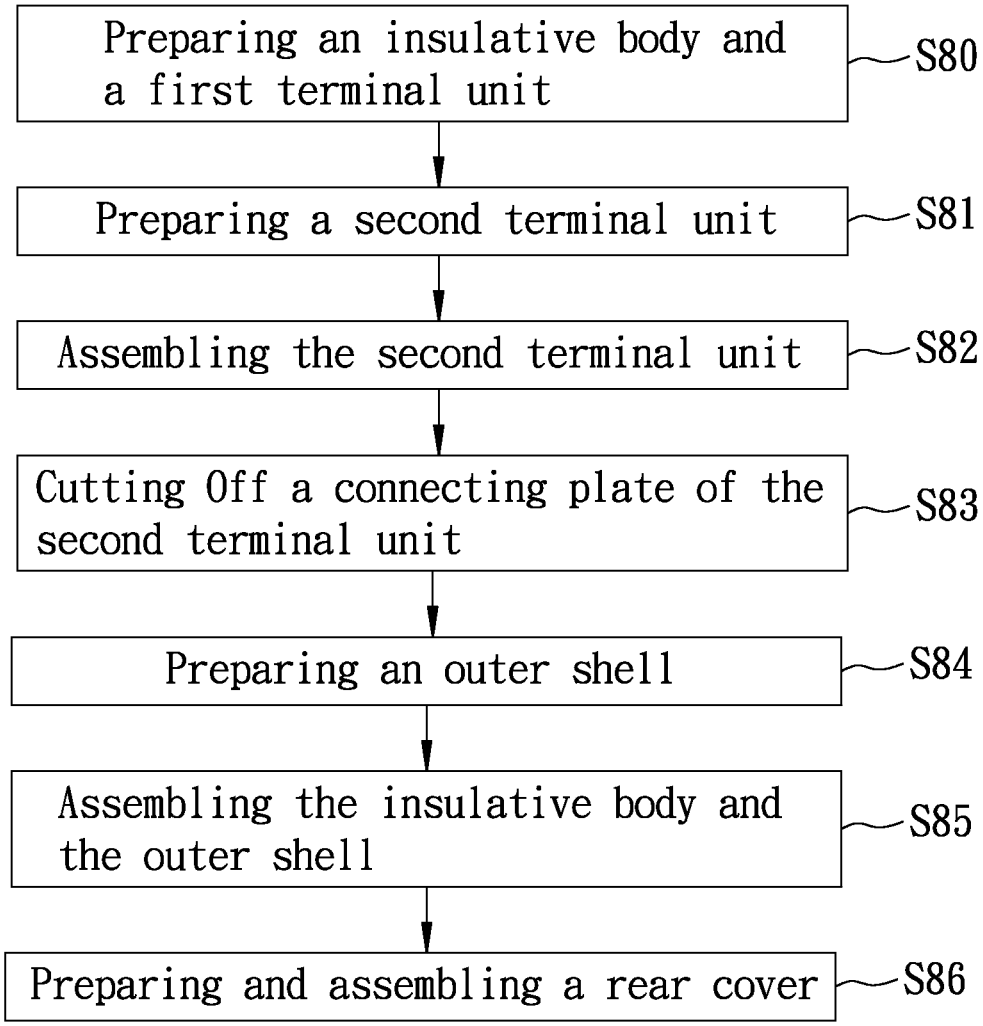
FIG. 18 is a flow diagram illustrating a preferred embodiment of a method of making a USB 3.0 connector according to this invention.
Figure 19:
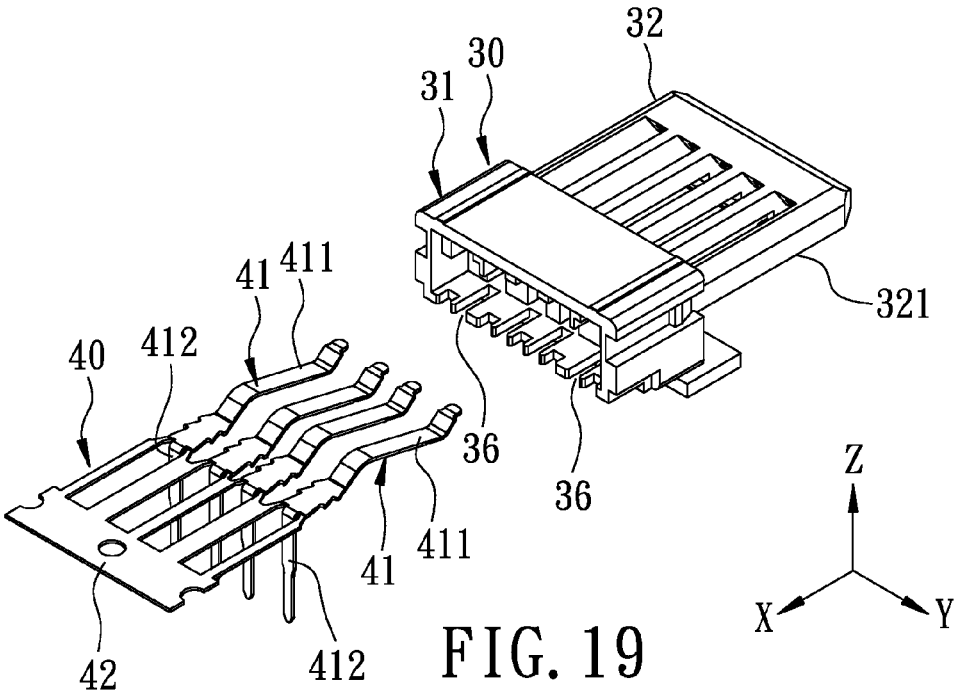
Figure 20:
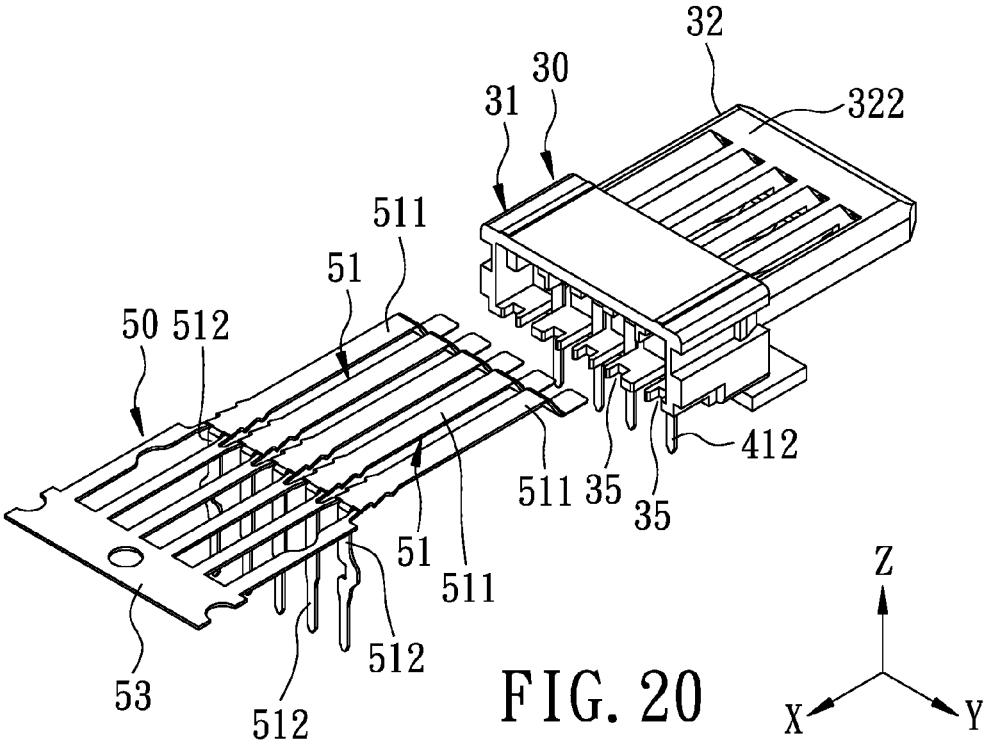

Referring to FIG. 18, the method of making the USB 3.0 connector according to the present invention includes the following steps S80~S86:

As shown in FIGS. 18 to 20, in step S80, the insulative body 30 and the first terminals 41 are assembled. During assembly, the first terminals 41 are first pushed forward such that the first contact plates 411 are fitted in the bottom side 321 of the tongue plate 32. Thereafter, the first legs 412 are extended respectively through the deep notches 36, and the first connection plate 42 is cut.

As shown in FIGS. 18 and 20, in step S81, the second terminals 51 are prepared. The second terminals 51 are connected by a second connection plate 53.

As shown in FIGS. 18, 20, 21 and 14, in step S82, the second terminals 51 are assembled. During assembly, the second terminals 51 are first pushed forward so that the second contact plates 511 are fitted in the top side 322 of the tongue plate 32, the second legs 512 are extended respectively through the shallow notches 35, and each of the outer two second terminals 51 has the projecting outer edge 523 abutting against an edge of the base lower wall 312 proximate to the respective one of the shallow notches 35, and has the indented inner edge 524 receiving and engaging an edge of the base lower wall 312 proximate to the respective one of the shallow notches 35.

Figure 14:
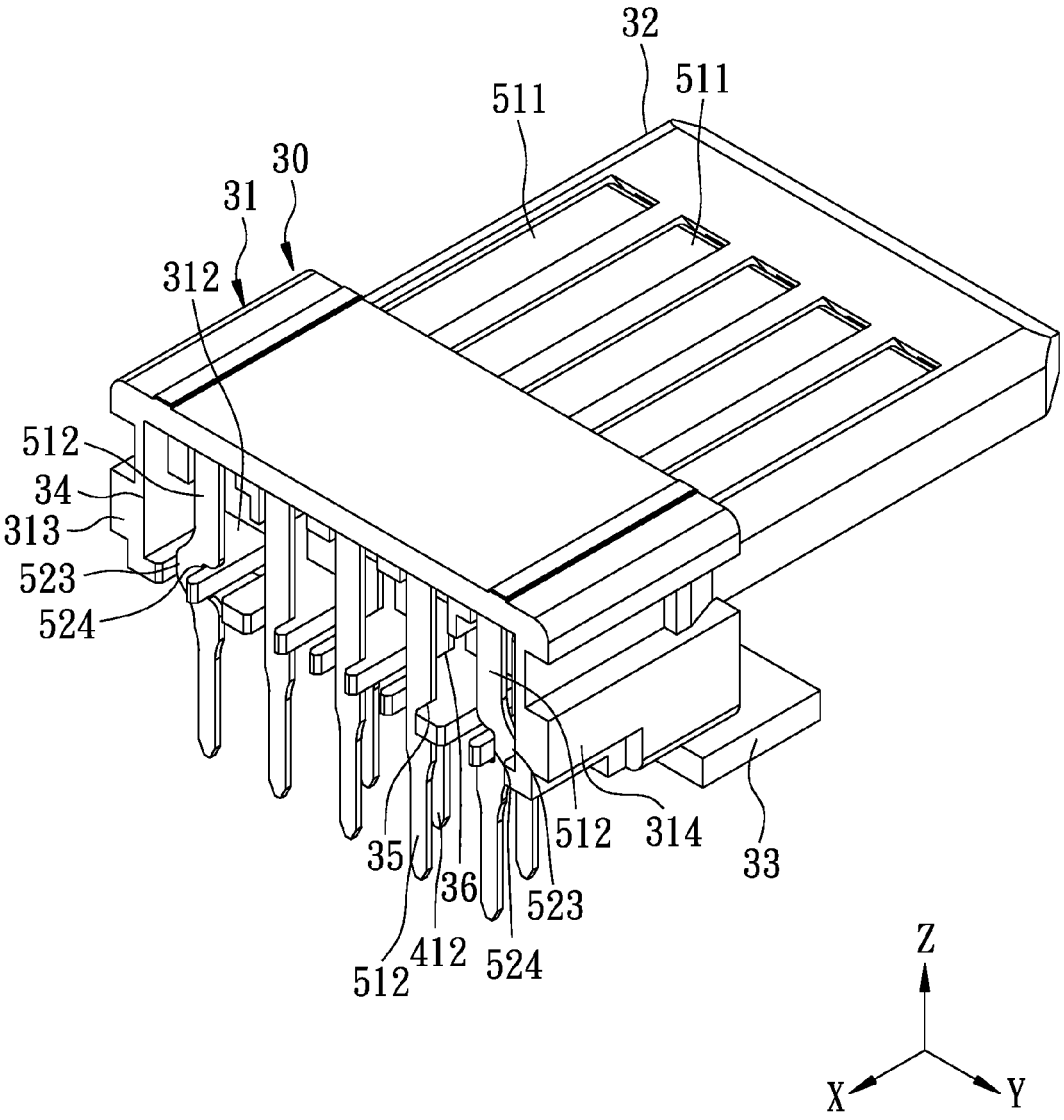
FIG. 14 is a partly assembled perspective view of the preferred embodiment for showing the insulative body, first terminals and second terminals.
Figure 15:
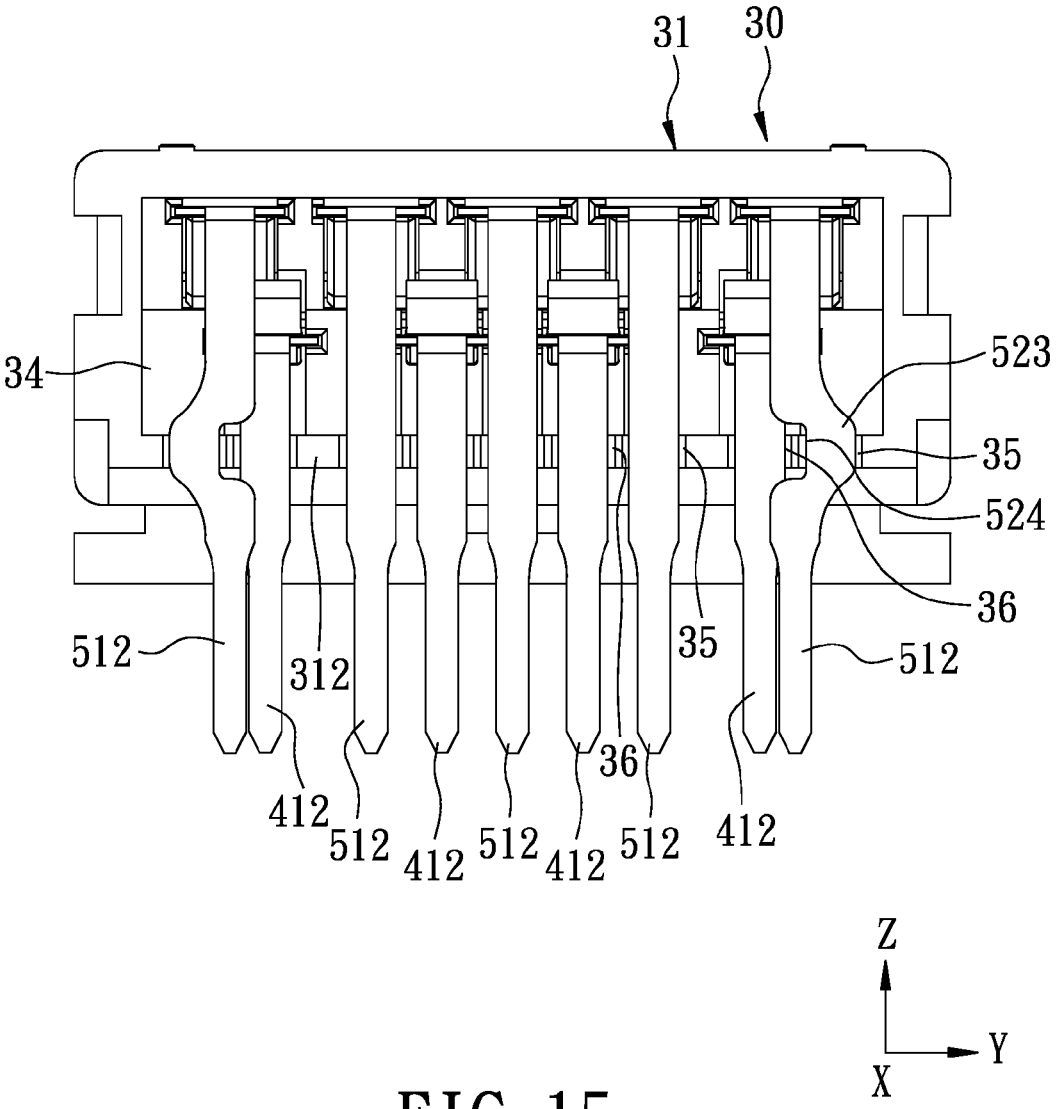
FIG. 15 is a rear view of the preferred embodiment.
Figure 16:
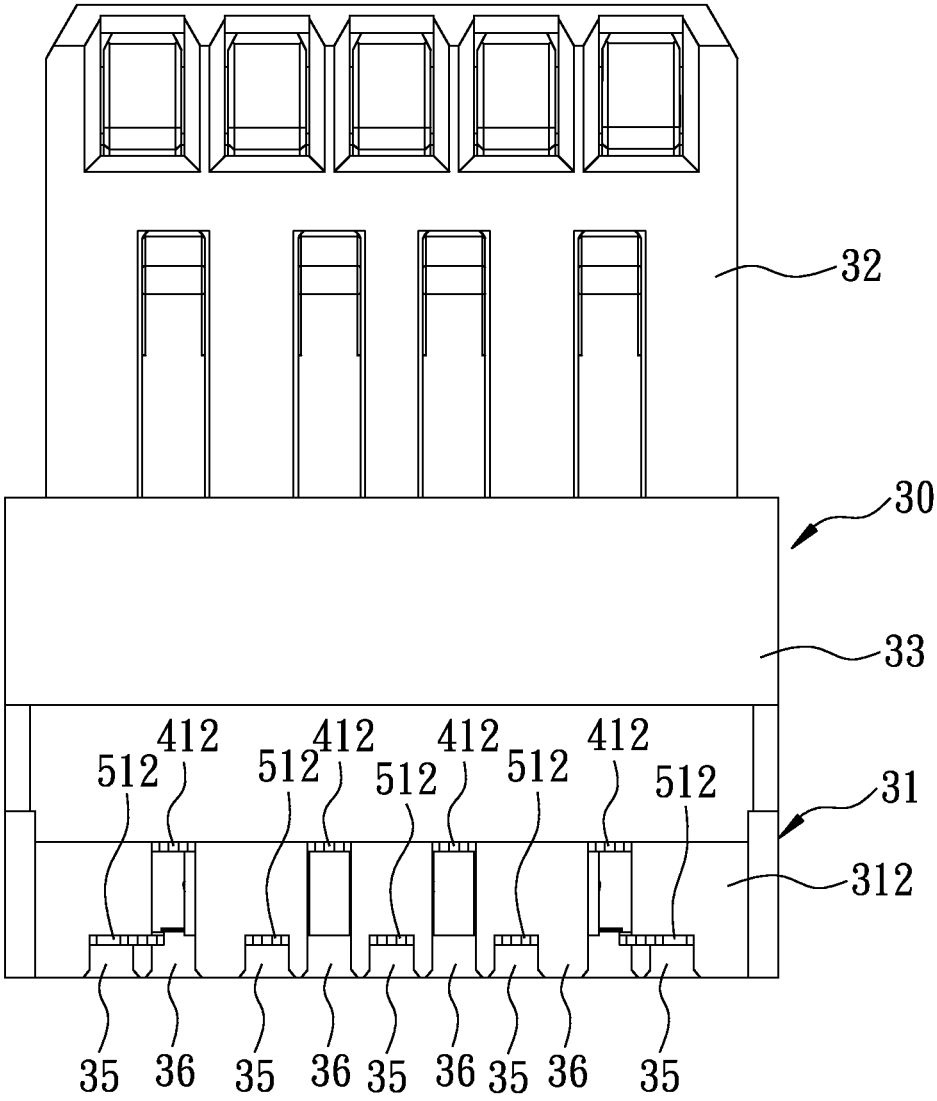
FIG. 16 is a bottom view of the preferred embodiment.
Figure 16:
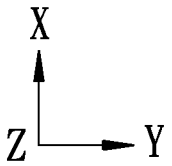
Figure 21:
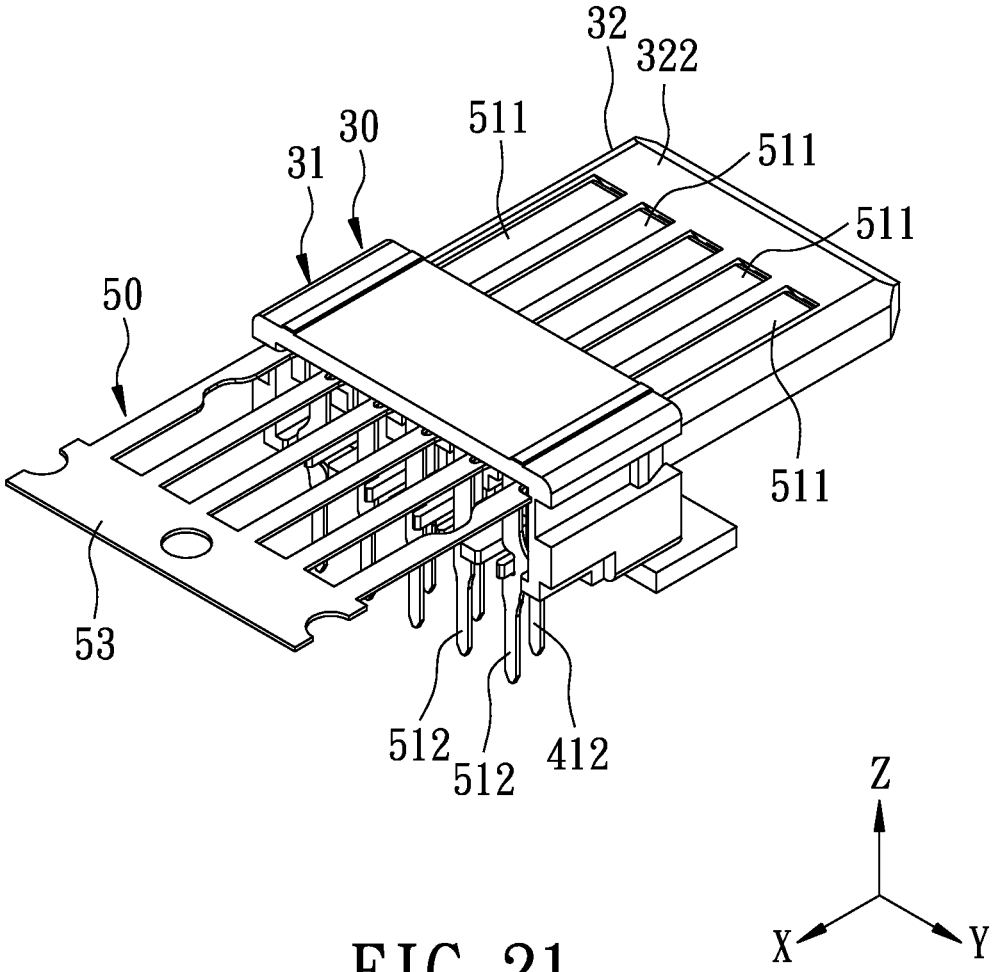

As shown in FIGS. 18, 21 and 14, in step S83, the second connection plate 53 is cut off.

Figure 22:
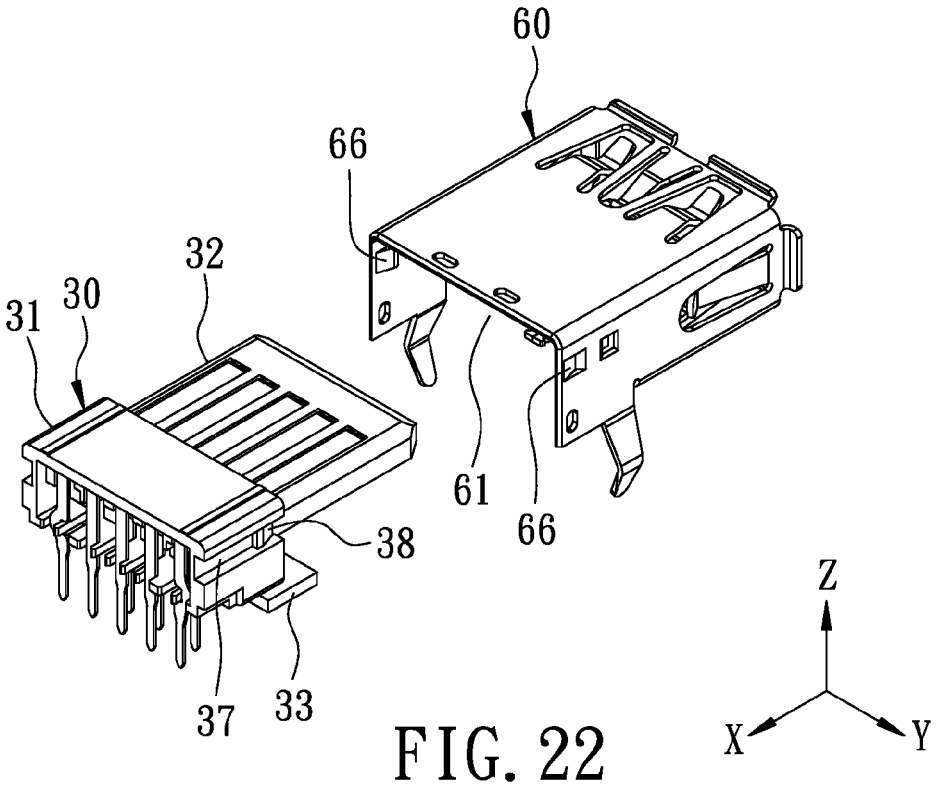

As shown in FIGS. 18 and 22, in step S84, the outer shell 60 is prepared.

Figure 23:
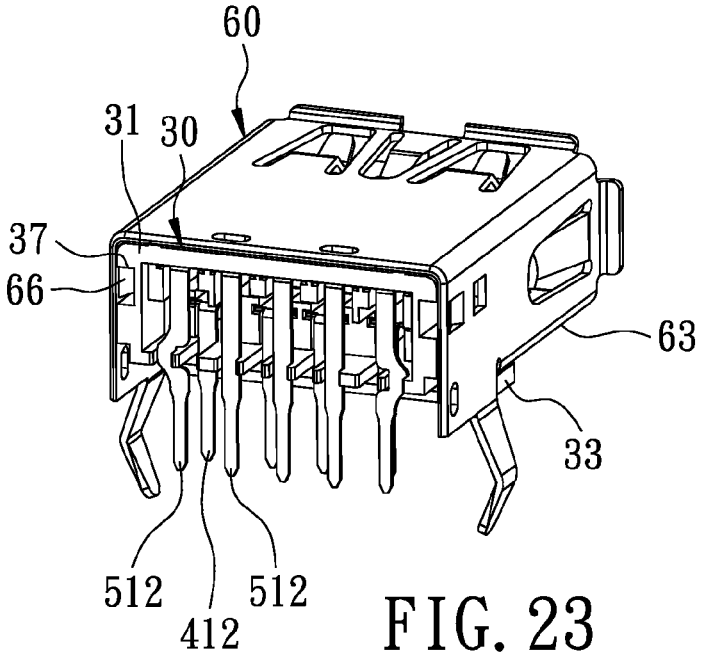

As shown in FIGS. 18, 22 and 23, in step S85, the outer shell 60 is assembled with the insulative body 30. By moving forwardly and inserting the insulative body 30 into the accommodation chamber 61 of the outer shell 60, the guide tabs 66 are guided into the respective guide grooves 37 and are slid over the respective wedge-shaped protrusions 38, the engaging lug 600 of the outer shell 60 is inserted into the engaging slot 39 of the base 31, the clamp plate 33 of the base 31 clamps the bottom side of the shell bottom wall 63, and the shell bottom wall 63 contacts against the base 31.

Figure 17:
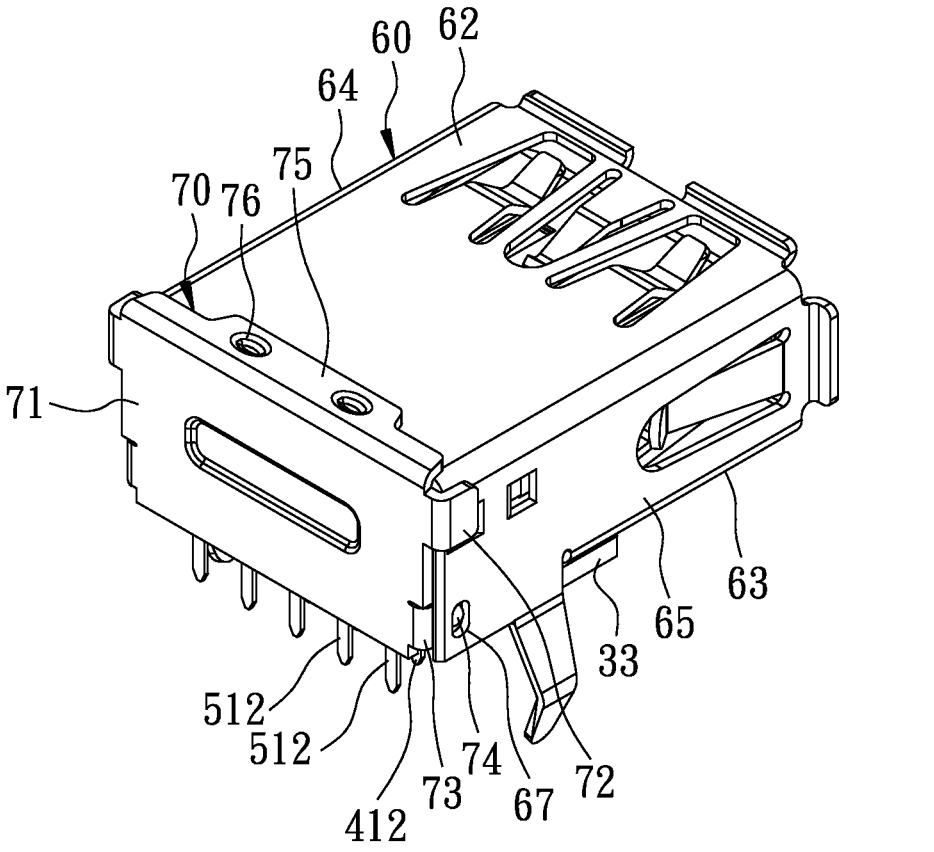
FIG. 17 is an assembled perspective view of the preferred embodiment.
Figure 17:
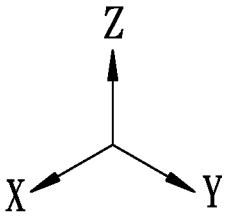

As shown in FIGS. 18, 24 and 17, in step S86, the rear cover 70 is assembled to the outer shell 60. During assembly, the top plate 75 is disposed above the shell top wall 62, the two second protrusions 76 engage the respective second positioning holes 69, the two inner clamp plates 73 clamp the corresponding shell sidewalls 64, 65, the two first protrusions 74 engage the respective first positioning holes 67. Because the outer shell 60 and the rear cover 70 are two independent components, there is an option to dispense with the rear cover 70.

The present invention provides the following advantages:

1) Due to the provision of the deep and shallow notches 36, 35 to space the first legs 412 apart from the second legs 512, the plastic positioning block 14 needed in the conventional USB 3.0 connector 10 can be dispensed with, thereby reducing the number of assembling components and the number of the manufacturing steps, lowering the manufacturing costs, and improving the production of quality products. In addition, the first and second terminals 41, 51 may be assembled with the insulative body 30 conveniently using an automatic assembling machine.

2) With the use of the stop plates 68 to stop the two protrusions 38 and the use of the engaging lug 600 to engage the engaging slot 39, the coupling effect of the insulative body 30 and the outer shell 60 is greatly enhanced, and the outer shell 60 is thus prevented from escaping from the insulative body 30.

3) Since the rear cover 70 is an independent component, it can be an optional component, which may be dispensed with. Thus, the number of assembling components is further reduced.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A method of making a USB 3.0 connector, comprising:

preparing an insulative body including a base that has a base upper wall, a base lower wall, and two base sidewalls interconnecting said base upper and lower walls, a tongue plate projecting forwardly from a front side of said base, a clamp plate projecting forwardly from a bottom side of said base lower wall, and a rear recess that is formed in a rear part of said base and that is surrounded by said base upper and lower walls and said base sidewalls, said base lower wall having a rear end notched in a frontward direction to form a plurality of alternating shallow and deep notches, each of said base sidewalls having a guide groove extending in a front-rear direction, and wherein said insulative body further includes an engaging slot formed in said front side of said base above said clamp plate;

preparing first terminals each having a first contact plate for fitting in a bottom side of said tongue plate, and a first leg bending downwardly from said first contact plate for extending through one of said deep notches;

fitting the first contact plates of the first terminals in the bottom side of the tongue plate, and extending the first legs respectively through the deep notches;

forming second terminals each having a second contact plate for fitting in a top side of said tongue plate, and a second leg bending downwardly from said second contact plate for extending through one of said shallow notches;

forming a connection plate which interconnects the second terminals;

assembling the second terminals with the tongue plate by pushing forwardly and fitting the second contact plates of the second terminals in the top side of the tongue plate, by extending the second legs of the second terminals through the shallow notches, respectively, and by engaging the second legs of two of the second terminals, which are respectively proximate to the base sidewalls, with the base lower wall in such a manner that each of the two second terminals has the projecting outer edge abutting against an edge of the base lower wall proximate to the respective one of the shallow notches, and has the indented inner edge receiving and engaging an edge of the base lower wall proximate to the respective one of the shallow notches;

cutting Of the connection plate of the second terminals;

preparing an outer shell for covering said insulative body and including a shell top wall, a shell bottom wall, and two shell sidewalls, said shell top wall being longer than and extending beyond a rear end of said shell bottom wall, each of said shell sidewalls having a guide tab for engaging said guide groove of one of said base sidewalls, and said outer shell further includes an engaging lug projecting rearwardly from said shell bottom wall, said shell bottom wall having a bottom side abutting against said clamp plate, said engaging lug being insertable into said engaging slot;

assembling the outer shell with the insulative body by moving forwardly and inserting the insulative body into an interior of the outer shell, wherein the guide tabs are guided into thenspective guide grooves by sliding over the respective wedge-shaped protrusions, the engaging lug of the outer shell is inserted into the engaging slot of the base, the clamp plate of the base clamps the bottom side of the shell bottom wall, and the shell bottom wall contacts against the base;

preparing a rear cover having a rear plate for covering said rear recess of said base, a top plate projecting forwardly from a top end of said rear plate, two outer clamp plates bending forwardly and respectively from two opposite ends of said rear plate for extending over outer sides of said shell sidewalls, respectively, two inner clamp plates bending forwardly and respectively from two opposite ends of said rear plate for insertion between said base and said outer shell, two first protrusions respectively projecting from outer surfaces of said inner clamp plates for engaging first positioning holes, and a second protrusion projecting downwardly from said top plate for engaging a second positioning hole; and arranging the rear cover to embrace the rear end of the outer shell in such a manner that the top plate of the rear cover extends over an upper side of the shell top wall, the second protrusion projecting into the second positioning hole in the shell top wall, the outer clamp plates respectively clamp and extend over outer sides of the shell sidewalls, the inner clamp plates are inserted between the base and the outer shell, and the first protrusions respectively engaging the first positioning holes.

* * * * *